US007694958B2

(12) United States Patent
Nakamura

(10) Patent No.: US 7,694,958 B2
(45) Date of Patent: Apr. 13, 2010

(54) SHEET FEEDING CASSETTE AND IMAGE FORMING APPARATUS

(75) Inventor: Mitsutaka Nakamura, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 484 days.

(21) Appl. No.: 11/675,381

(22) Filed: Feb. 15, 2007

(65) Prior Publication Data

US 2007/0189822 A1 Aug. 16, 2007

(30) Foreign Application Priority Data

Feb. 15, 2006 (JP) ..... 2006-038136

(51) Int. Cl.
*B65H 1/04* (2006.01)

(52) U.S. Cl. ..... 271/171; 271/145; 399/393

(58) Field of Classification Search ..... 271/171, 271/145; 399/393

See application file for complete search history.

(56) References Cited

FOREIGN PATENT DOCUMENTS

| | | | | |
|---|---|---|---|---|
| JP | 01209227 | A | * | 8/1989 |
| JP | 05-278869 | | | 10/1993 |
| JP | 06009067 | A | * | 1/1994 |
| JP | 08169563 | A | * | 7/1996 |
| JP | 11116069 | A | * | 4/1999 |
| JP | 11-139676 | | | 5/1999 |
| JP | 2004-315229 | | | 11/2004 |
| JP | 2005-047684 | | | 2/2005 |
| JP | 2005-053645 | | | 3/2005 |
| JP | 2005145706 | A | * | 6/2005 |
| JP | 2005-231862 | | | 9/2005 |

* cited by examiner

*Primary Examiner*—Patrick H Mackey
*Assistant Examiner*—Luis Gonzalez
(74) *Attorney, Agent, or Firm*—Oblon, Spivak, McClelland, Maier & Neustadt, L.L.P.

(57) ABSTRACT

A sheet feeding cassette, including a main body of the sheet feeding cassette accommodating sheets having a trench; a fence movably attached to the main body configured to define a setting position of the sheets; a fixing portion included in the fence that includes a tooth portion engaging with the trench and turns to substantially perpendicular direction of the moving direction of the fence; a lever portion included in the fence that is possible to move corresponding to the moving direction of the fence and the lever portion configured to rotate the fixing portion by moving of the lever portion.

15 Claims, 15 Drawing Sheets

SHEET FEEDING CASSETTE AND IMAGE FORMING APPARATUS

CROSS-REFERENCE TO RELATED APPLICATIONS

The present application claims priority to Japanese Patent Application No. 2006-038136 filed in the Japanese Patent Office on Feb. 15, 1006, the disclosure of which is incorporated herein by reference.

BACKGROUND OF THE INVENTION

1. Field of the Invention

The present invention relates to a sheet feeding cassette accommodating sheets of a recording medium (e.g., paper) and an image forming apparatus including the sheet feeding cassette, for example, a copier, facsimile, plotter, or printing machine.

2. Description of the Related Art

In a sheet feeding cassette of an image forming apparatus including a sheet feeding cassette accommodating sheets, a fence (side fence) that defines the position of the sheets perpendicular to a direction of sheet feeding is needed because the accuracy of the position of the fence directly affects a skew angle of the sheet feeding.

It is preferable that a light force is required to move the fence because a user directly operates the fence to accommodate various sizes of sheets.

The fence is also needed to be affixed securely at each setting position, and to move smoothly when the user changes the setting. Japanese Patent Laid-Open Application No. 2005-131861 discloses a sheet feeding cassette where a user can release the fence by pushing a button and the user can reengage the fence in a fixed state by pushing the button after moving the fence to a desirable position.

However, this sheet feeding cassette configuration has drawbacks because the pushing direction of the button and the moving direction of the fence are in discord. That is, use of the fence requires an unnatural user applied force to adjust the fence to an accurate position.

Japanese Patent Laid-Open Application No. 1999-139576 discloses a sheet feeding cassette where the user can release the fence from a fixed state by rotating a fixing portion perpendicular to the moving direction of the fence.

However, as discussed above, the sheet feeding cassette has drawbacks because the releasing direction of the fixing portion and the moving direction of the fence are in discord. Consequently, an unnatural force is required to adjust the location of the fence to an accurate position.

Japanese Patent Laid-Open Application No. 2005-053645 discloses a sheet feeding cassette where the user can release an engagement of a tooth portion positioned below the fence and the body of the sheet feeding cassette by pushing a lever and the user can fix the location of the fence by pushing the lever after moving the fence to a desirable position. This sheet feeding cassette is more preferable than the configurations described above because the pushing direction of the button and the moving direction of the fence are consistent with each other.

However, this configuration has drawbacks because a trench wall exists in the rotating direction of the tooth portion and the tooth portion strikes against the wall. Consequently, friction may occur and additional effort is required by the user to operate the fence.

In order to use a sheet P having variable widths, the user may move the side fence 9*a*, 9*b* to accommodate the sheet P.

The fence is needed to fix tightly at the desirable position to avoid skewing. Further, the fence is needed to move smoothly when the user operates.

More specifically, Japanese Patent Laid-Open Application No. 2005-053645 and Japanese Patent Laid-Open Application No. 2004-315229 disclose a sheet feeding cassette having the fixing structure of the fence illustrated in FIG. 5.

As illustrated in FIG. 5, a fence 9 is controlled by a lever 15. The user pushes a knob 15*a*, positioned at the top of the lever 15, using a finger toward the direction of an arrow 16 to release the fence 9. A tooth portion 15*b* is provided at the bottom of the lever 15. The tooth portion 15*b* pivots upward in the direction of arrow 17 in response to pushing the knob 15*a*. Below the tooth portion 15*b*, a trench 19 is provided as part of the main body of cassette 18. The fence 9 can be fixed or released by engaging or releasing the engagement of the tooth portion 15*b* and the trench 19. The trench 19 is aligned at a predetermined pitch toward the moving direction of the fence 9.

FIG. 6 is a cross-section view showing the tooth portion 15*b* and the trench 19 at the engagement position. As illustrated in FIG. 6, the tooth portion 15*b* of the lever 15 pivots upward when the knob 15*a* is pushed by the user. The user can set the position of the fence 9 to the width of the paper "P" easily because the user can move the fence by moving the knob 15, and the direction of movement of the fence 9 is consistent with the direction of movement of the knob 15*a*.

However, the direction of the releasing movement of the tooth portion 15*b* (i.e., the direction of arrow 17) is perpendicular to the vertical wall 19*a* provided in the trench 19. Consequently, the tooth portion 15*b* sometimes strikes against the vertical wall 19*a* of the trench 19, and the force necessary to release the fence becomes enormous.

SUMMARY OF THE INVENTION

The present invention addresses the above described problems of the related art. Accordingly, it is an object of the present invention to provide a sheet feeding cassette and an image forming apparatus which operates smoothly by corresponding the pushing direction of the lever to release the fence with the moving direction of the fence and by lightening the force needed to move the lever to release the fence.

A specific object of the present invention is to provide a sheet feeding cassette including a main body configured to accommodate at least one sheet, and including a trench; and a fence attached to the main body and configured to move bi-directionally define a setting position for the at least one sheet. A fixing portion includes a tooth portion configured to engage with the trench to fix a position of the fence. The fixing portion is configured to rotate in a direction substantially perpendicular to the moving direction of the fence. A lever portion configured to contact the fixing portion when moved in a direction parallel to the moving direction of the fence resulting in a rotation of the fixing portion. As a consequence of this configuration, the tooth portion disengages smoothly from the trench and less force is needed to operate the fence to change sheet sizes. A user can set the fence to an accurate position and consequently prevent skewing of the sheet feeding. The user can operate the fence easily because the user can operate the fence and the fixing portion sequentially.

According to an embodiment of the present invention, the lever portion and the fence are integrally formed. An integrated formation is less expensive than forming the lever portion and the fence separately.

According to another embodiment, the lever portion or the fixing portion includes a slope portion. By moving the lever portion, the lever portion pushes the slope portion of the fixing portion. The fixing portion is moved by a component force generated on the slope portion. A force to move the lever is used to move the fence effectively.

According to another embodiment, the sheet feeding cassette further includes a biasing device configured to bias the fixing portion.

After setting the sheets, the declination of the fence may be reduced because the fence can be fixed securely by engaging the tooth portion of the fence and the trench. According to another embodiment, the sheet feeding cassette further includes a cover configured to cover substantially the entire portion of the fixing portion. The cover can improve aspects of the fence, for example, the cover makes the device more user friendly by reducing the number of elements which can be accessed by the user.

According to another embodiment, the cover includes a guide portion configured to restrict a deflection of the lever portion in a perpendicular direction of movement. Consequently, the fixing or releasing of the fence can be operated stably.

According to another embodiment, the fixing portion includes a protruding portion and the fence includes an engaging portion. As a consequence of this configuration, the fixing portion is more durable because the force on to the tooth portion is reduced when closing or opening the side fence.

According to another embodiment, the fixing portion includes a plurality of tooth portions. As a consequence of this configuration, the operation of fixing and releasing the fence is stabilized.

BRIEF DESCRIPTION OF THE DRAWINGS

A more complete appreciation of the present invention, and many of the attendant advantages thereof, will be readily obtained as the same becomes better understood by reference to the following detailed description when considered in connection with the accompanying drawings, wherein.

DETAILED DESCRIPTION OF THE PREFERRED EMBODIMENTS

Figure 1:
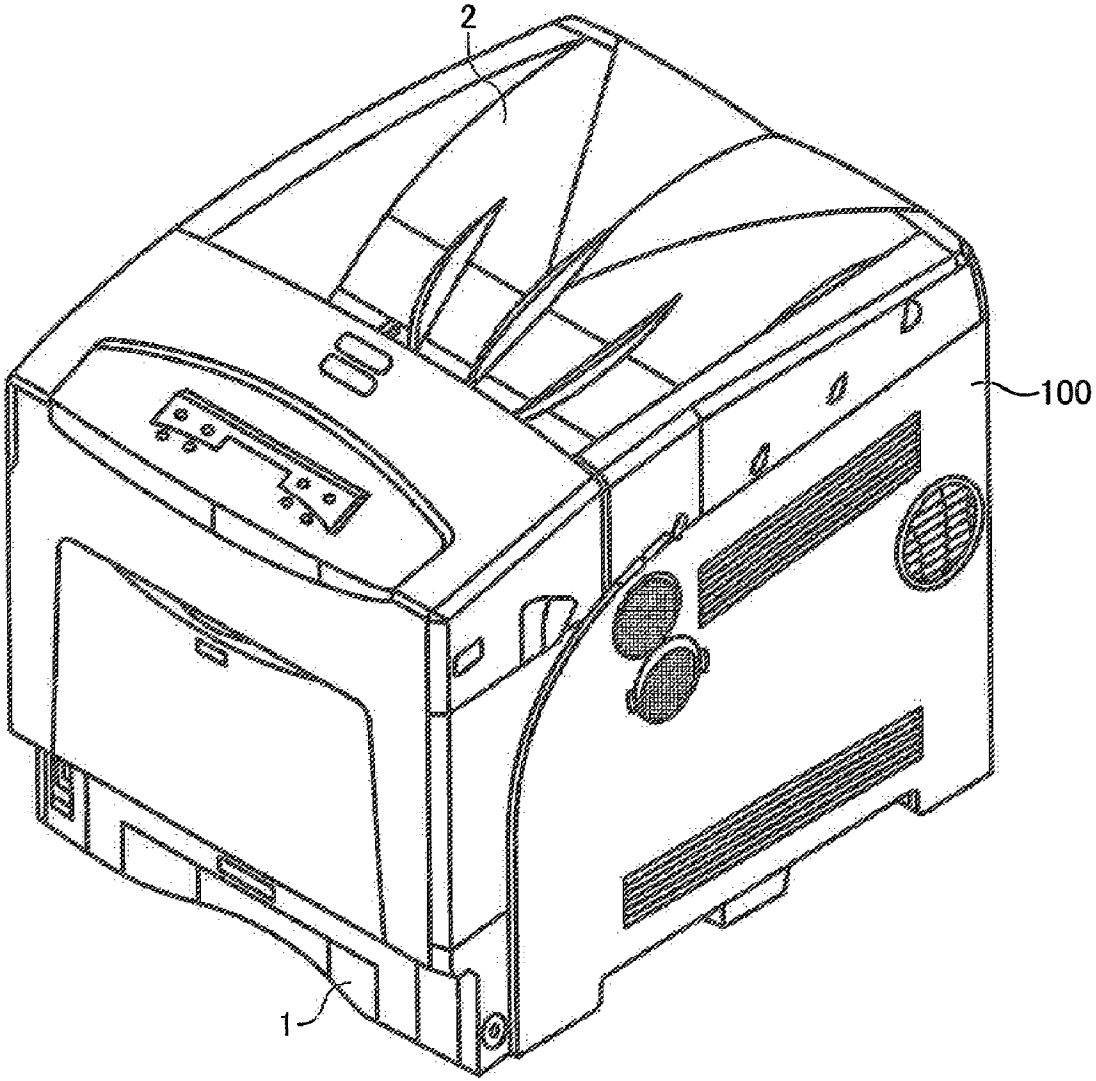
FIG. 1 is a perspective view of a laser beam printer according to an embodiment of the present invention.

Preferred embodiments of the present invention are described in detail referring to the drawings, wherein like reference numerals designate identical or corresponding parts throughout the several views.

The first embodiment of the present invention is described in detail referring to the FIGS. 1-4 and 7-11.

FIG. 1 is a perspective view of a laser beam printer as an example of an image forming apparatus according to an embodiment of the present invention. A sheet feeding cassette 1 is provided in a body portion a main body case 100 of the printer. In a top surface of the main body case 100, a sheet discharging tray 2 is formed. The sheet (S), having a fixed toner image provided thereon, is discharged and stacked on the sheet discharging tray 2.

Figure 2:
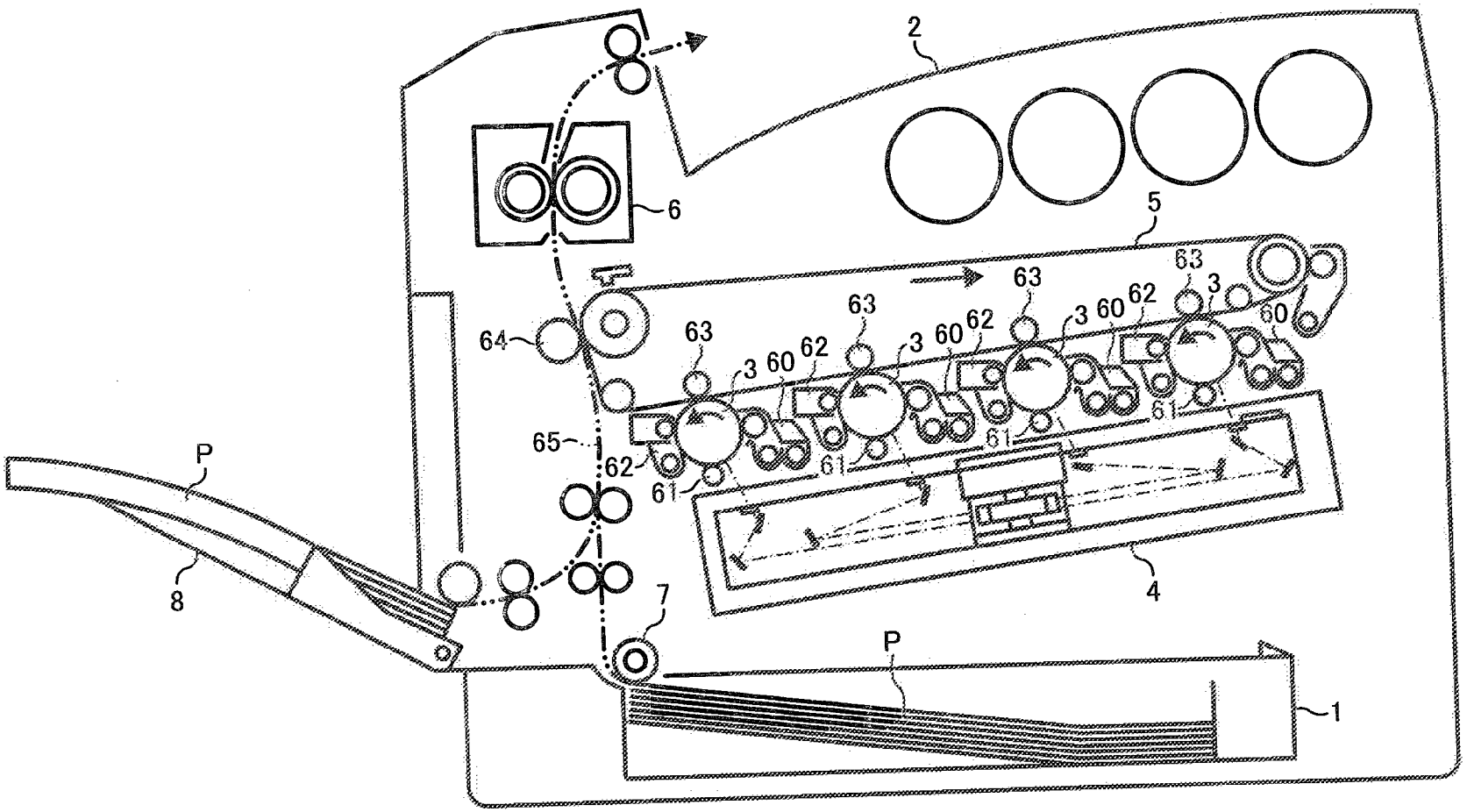
FIG. 2 is a cross-section view showing an overall configuration of a laser beam printer according to an embodiment of the present invention shown in FIG. 1

FIG. 2 is a cross-section view of FIG. 1 showing an overall configuration of the laser beam printer according to an embodiment of the present invention.

The image forming apparatus includes a drum shaped photoreceptor 3, a charging device 61, a developing device 60, a transfer belt 5, a cleaning device 62, and a fixing device 6 which collectively form a device for forming an image which is provided for each of the colors (yellow, magenta, cyan, black). Specifically, a light writing device 4 irradiates a surface of the photoreceptor 3 with a light, thereby forming an electrostatic latent image on the photoreceptor 3. The charging device 61 uniformly charges the unexposed surface of the photoreceptor 3. The developing device 60 develops the electrostatic latent image on the photoreceptor 3 with toner and forms a toner image. The first transfer device 63 transfers the toner image formed on the photoreceptor 3 onto the transfer belt 5. The second transfer device 64 transfers the toner image formed on the transfer belt 5 onto the sheet.

After the toner image formed on the photoreceptor 3 is transferred onto the transfer belt 5, the cleaning device removes residual toner remaining on the photoreceptor 3.

A sheet feeding path 65 is included in a front section of the main body case 100 and is substantially vertical around the second transfer device 64. The sheet feeding cassette 1 for feeding a paper to the sheet feeding path 64 is provided at the lower portion of the main body case 100. Specifically, the sheet feeding cassette 1 can be pulled out from the front of the main body case 100.

Figure 3:
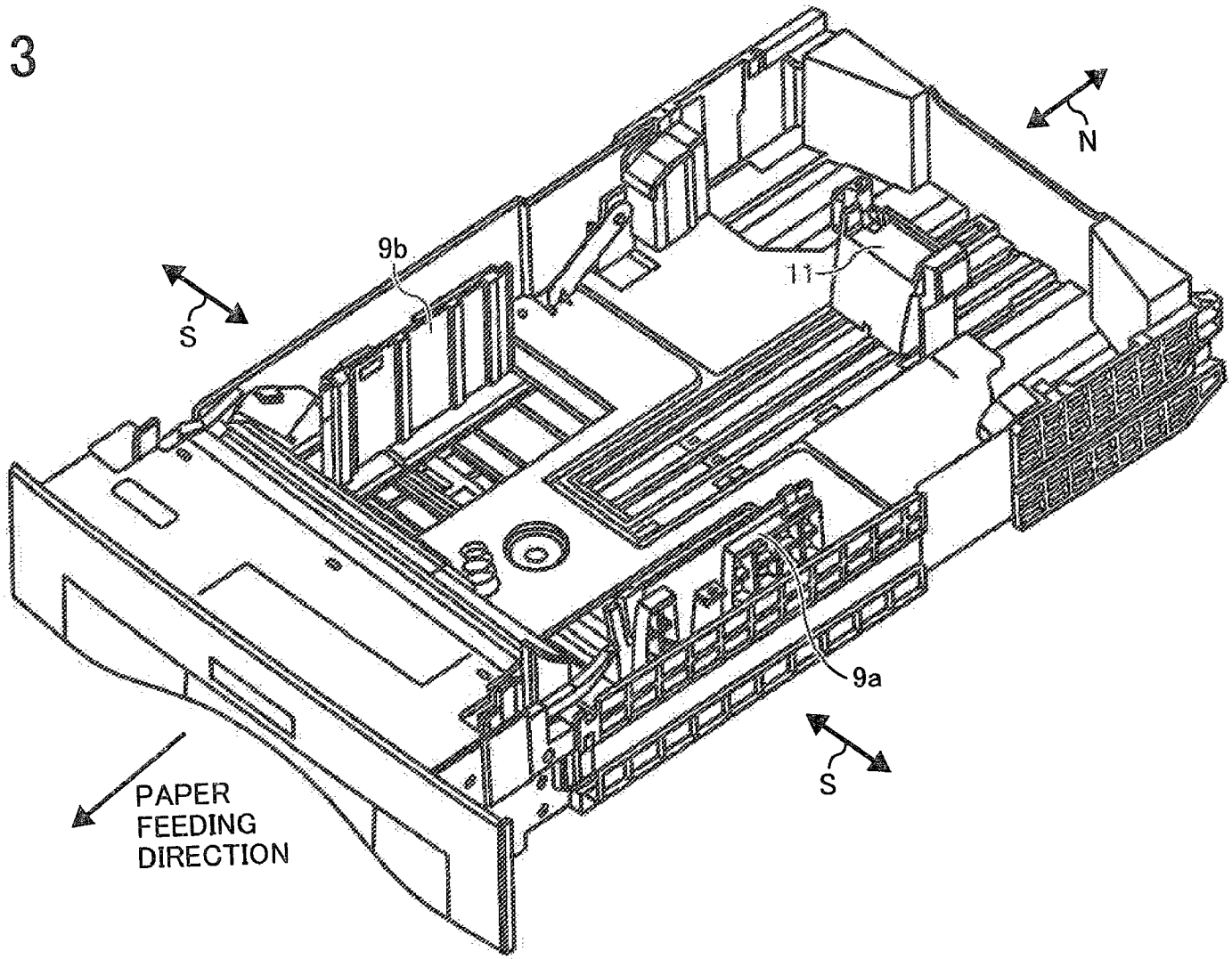
FIG. 3 is a perspective view of a sheet feeding cassette according to an embodiment of the present invention.

A sheet accommodated in the sheet feeding cassette 1 is fed one by one by a sheet feeding roller 7, goes through the sheet feeding path 65, and is discharged to the sheet discharging tray 2. At a front surface of the main body case 100, an openable and closable manual sheet feeding tray 8 is provided to manually supply the sheet, if desired. FIG. 3 is a perspective view of the sheet feeding cassette according to an embodiment of the present invention.

The sheet feeding cassette 1 includes, as illustrated in FIG. 3, a pair of side fences 9*a*, 9*b* for confining sheets in a direction perpendicular to the sheet feeding direction. The side fences 9*a*, 9*b* slidably move in the widthwise direction (in the direction of an arrow "S") of the sheets.

The end fence 11 is slidable along the sheet feeding direction and aligns the trailing edges of the sheets in the cassette in the sheet feeding direction (in the direction of an arrow ("N").

A user can set sheets in the sheet feeding cassette 1 by following these steps: sliding the side fences 9*a*, 9*b* outward, sliding the end fence 11 outward, setting the sheets in the sheet feeding cassette 1, sliding the side fences 9*a*, 9*b* inward, sliding the end fence 11 inward, and then making fine adjustments to the positions of the side edges in the widthwise direction and the trailing edges in the sheet feeding direction.

Figure 4:
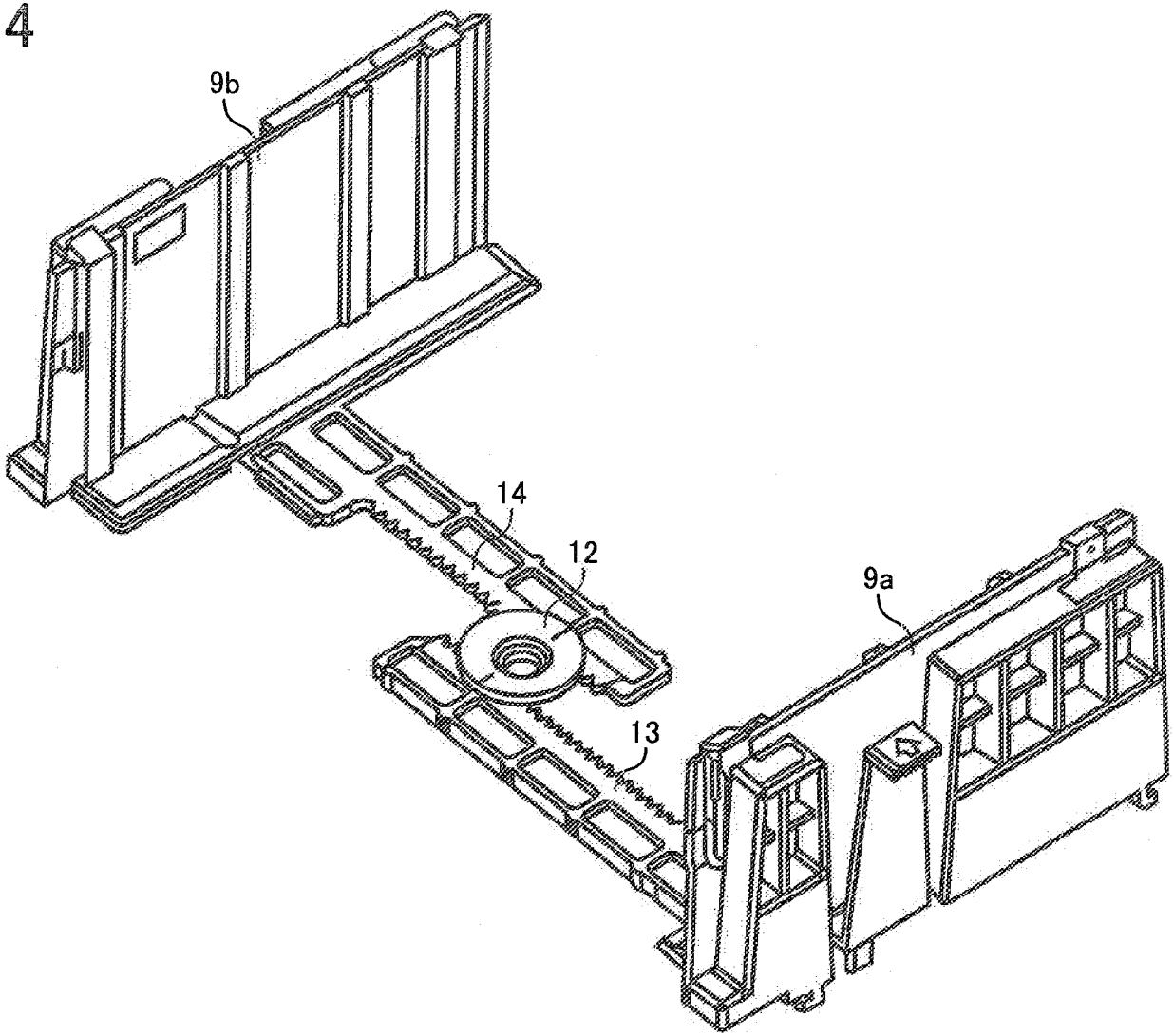
FIG. 4 is a perspective view of side fences and a linkage according to an embodiment of the present invention.
Figure 5:
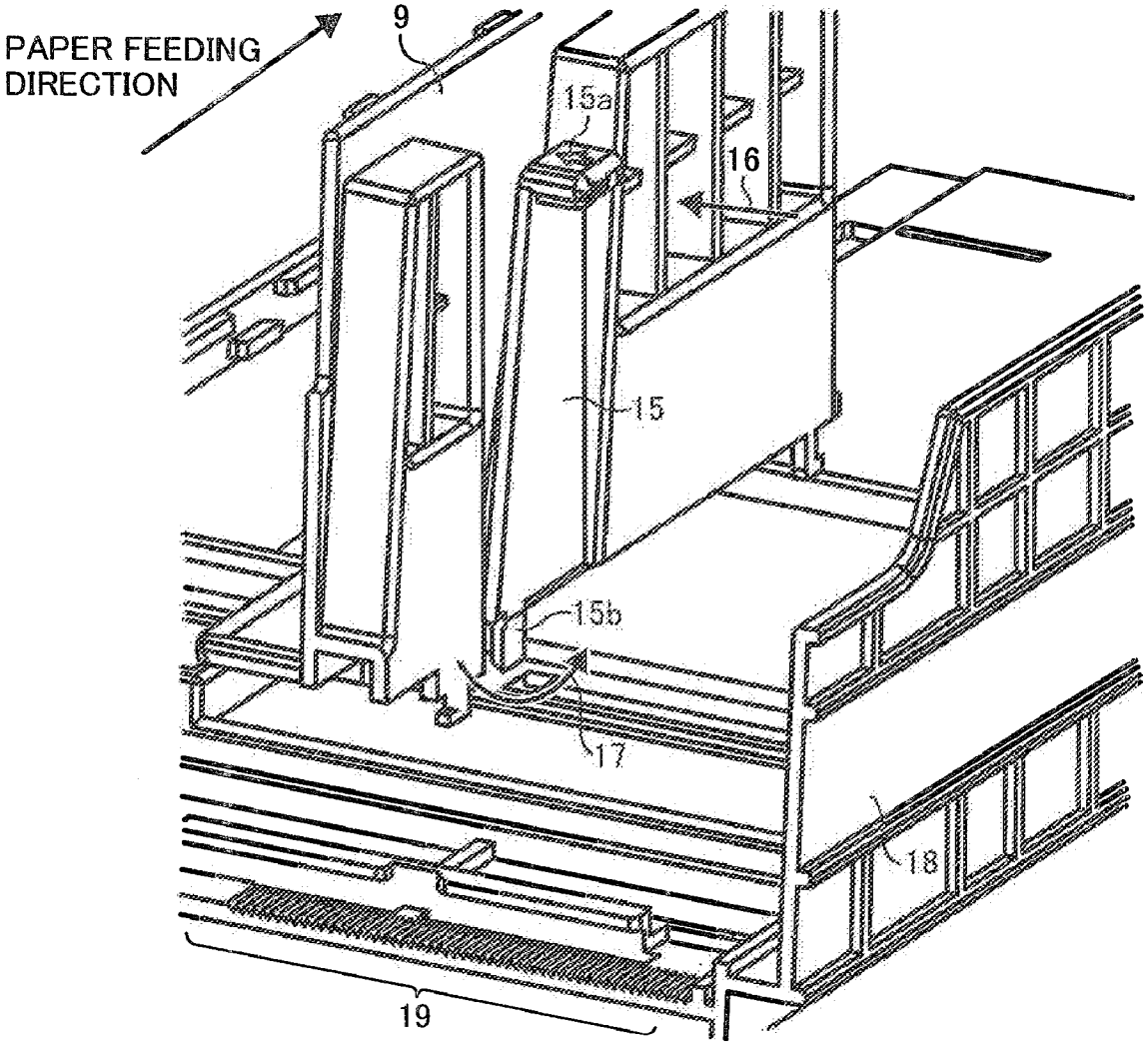
FIG. 5 is a perspective view of a fixing structure of a fence according to the related art.
Figure 6:
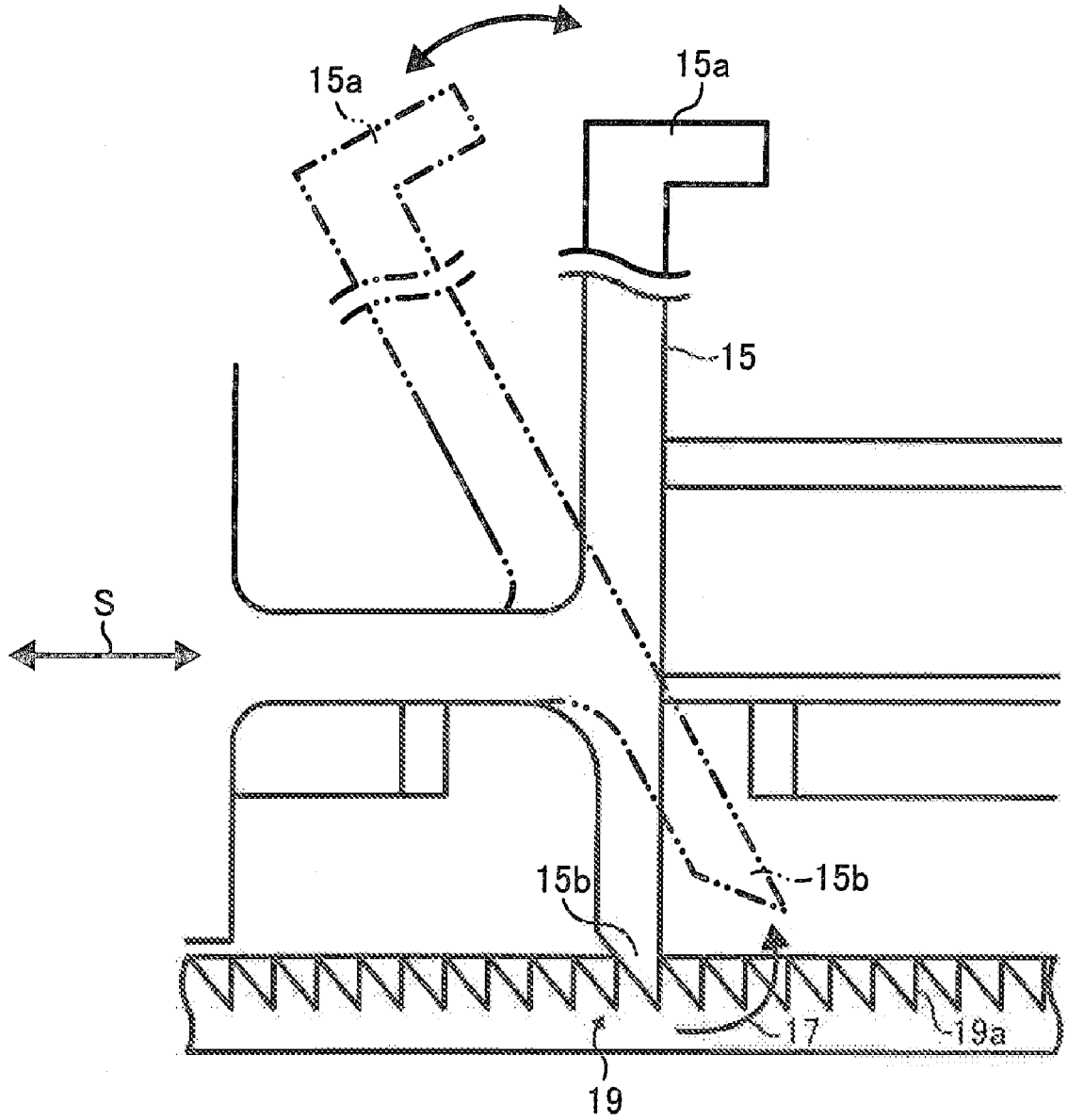
FIG. 6 is a cross-section view showing the tooth and the trench according to the related art.

FIG. 4 is a perspective view of the side fences 9*a*, 9*b* and a linking device according to an embodiment of the present invention.

The side fences 9*a*, 9*b* include an integrated rack 14 and a pinion gear 12 engaged with the rack 14. Side fence 9*a* moves coincidentally with fence 9*b*.

Figure 7:
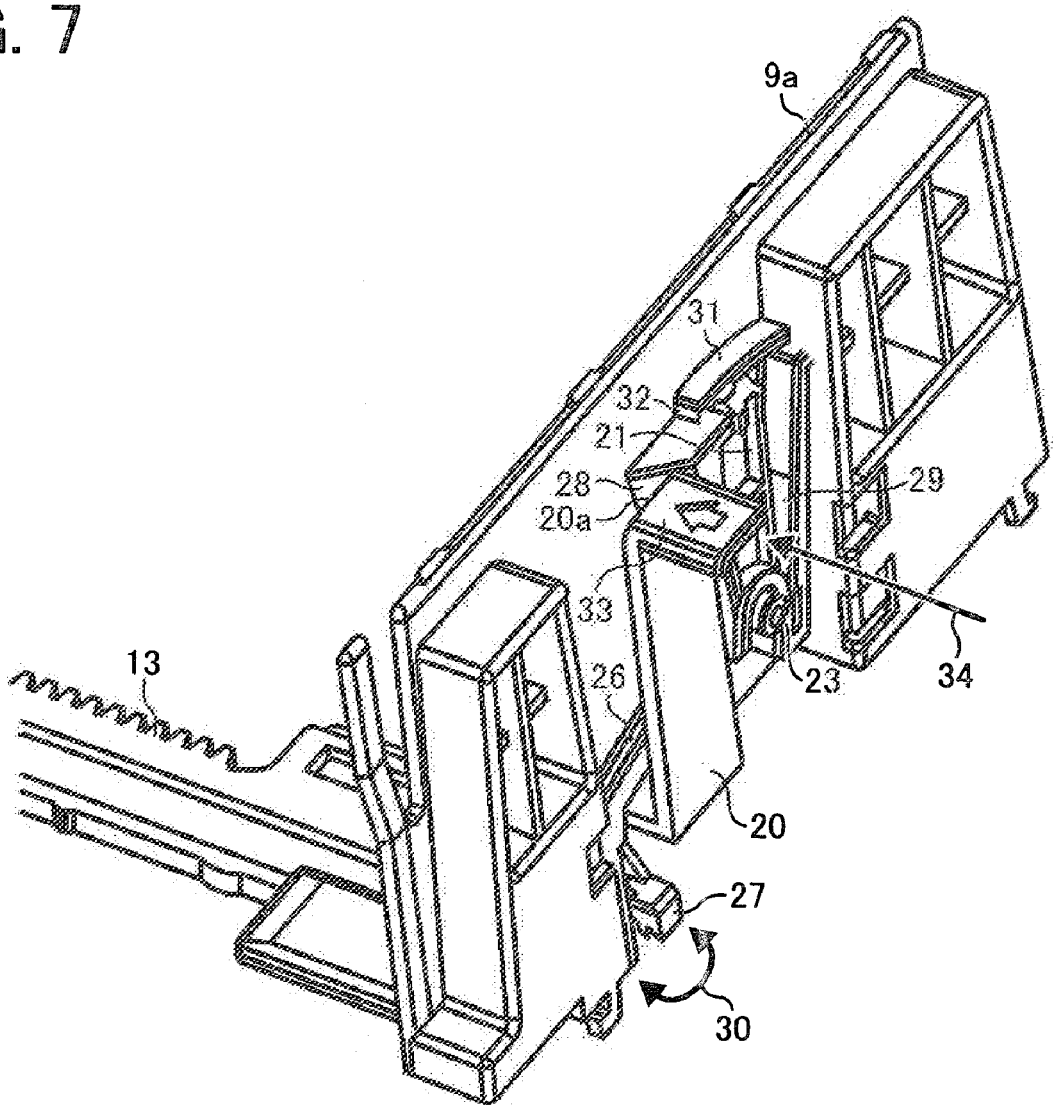
FIG. 7 is a perspective view of a fixing structure of a fence according to an embodiment of the present invention.

FIG. 7 is a perspective view of a fixing structure of a fence according to an embodiment of the present invention.

As illustrated in FIG. 7, a lever 20 is provided on the outer side of the side fence 9*a* which is movable in the moving direction of the side fence 9*a*. A fixing portion 21 is also provided on the outer side of the side fence 9*a* which is moveable in a direction substantially perpendicular to the moving direction of the side fence 9*a*.

Figure 8:
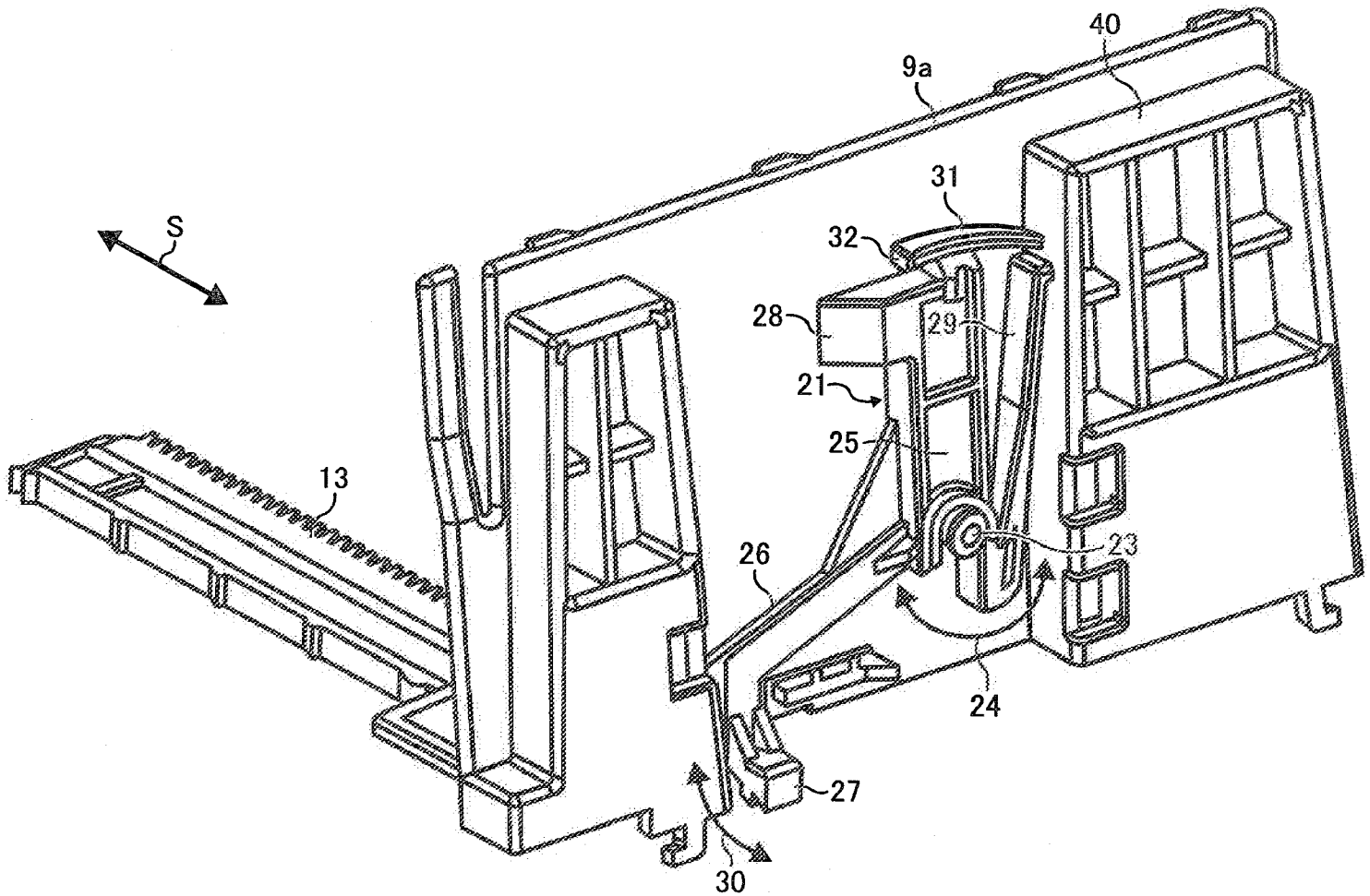
FIG. 8 is a cross-section view showing the fixing structure of a fence according to an embodiment of the present invention.

As illustrated in FIG. 8, the fixing portion 21 includes a fixing main body 25 turnable to a direction substantially perpendicular to the moving direction of the side fence 9*a*. The fixing main body 25 is supported by an axis 23 at the bottom portion of the fixing main body 25. An arm portion 26 radiates from the bottom portion of the fixing main body 25 toward a direction substantially perpendicular to the moving direction of the side fence 9*a*. A tooth portion 27 is provided on a toe of the arm portion 26. A slope portion 28 is provided at an upper part of the fixing main body 25, and a leaf spring 29 is integrated at the bottom portion of the fixing main body 25. The leaf spring 29 is formed in a "V-shape" and is provided between the fixing main body 25 and a box portion 50 of the side fence 9*a*. Specifically, for the engagement of the tooth portion 27 and a trench 19 (illustrated in FIG. 9), the leaf spring 29 exerts a force on the fixing main body 25 to make the fixing main body 25 rotate in a counterclockwise direction. The fixing main body 25, the tooth portion 27, and the leaf spring 29 can be integrally molded using a synthetic resin. By rotating the fixing main body 25, the tooth portion 27 is moved up and down. Specifically, the tooth portion 27 can move in the direction of the arrow 30 illustrated in FIG. 8. In other words, the tooth portion 27 can be moved in a direction substantially perpendicular to the moving direction of the side fence 9*a*. The movement of the fixing main body 25 is regulated by a curved guide portion 31 integrally formed with the side fence 9*a*. A regulating portion 32 provided on the left side of the guide portion 31 regulates an over rotation in a counterclockwise direction.

As illustrated in FIG. 7, by pushing a knob 33 of the lever 20 in the moving direction of the side fence 9*a* (a direction of an arrow 34) an inner side 20*a* of the lever 20 contacts a slope portion 28 of the fixing main body 25 resulting in the fixing main body 25 turning clockwise in response to the component force generated at the slope portion 28. More specifically, moving the lever 20 starts the rotation of the fixing main body 25, the engagement of the tooth portion 27 and the trench 19 (illustrated in FIG. 9) is released, and then the fixing of the side fences 9*a*, 9*b* is released. The user can fix the side fences 9*a*, 9*b* using the elastic force of the leaf spring 29 by releasing the lever 20.

Figure 9:
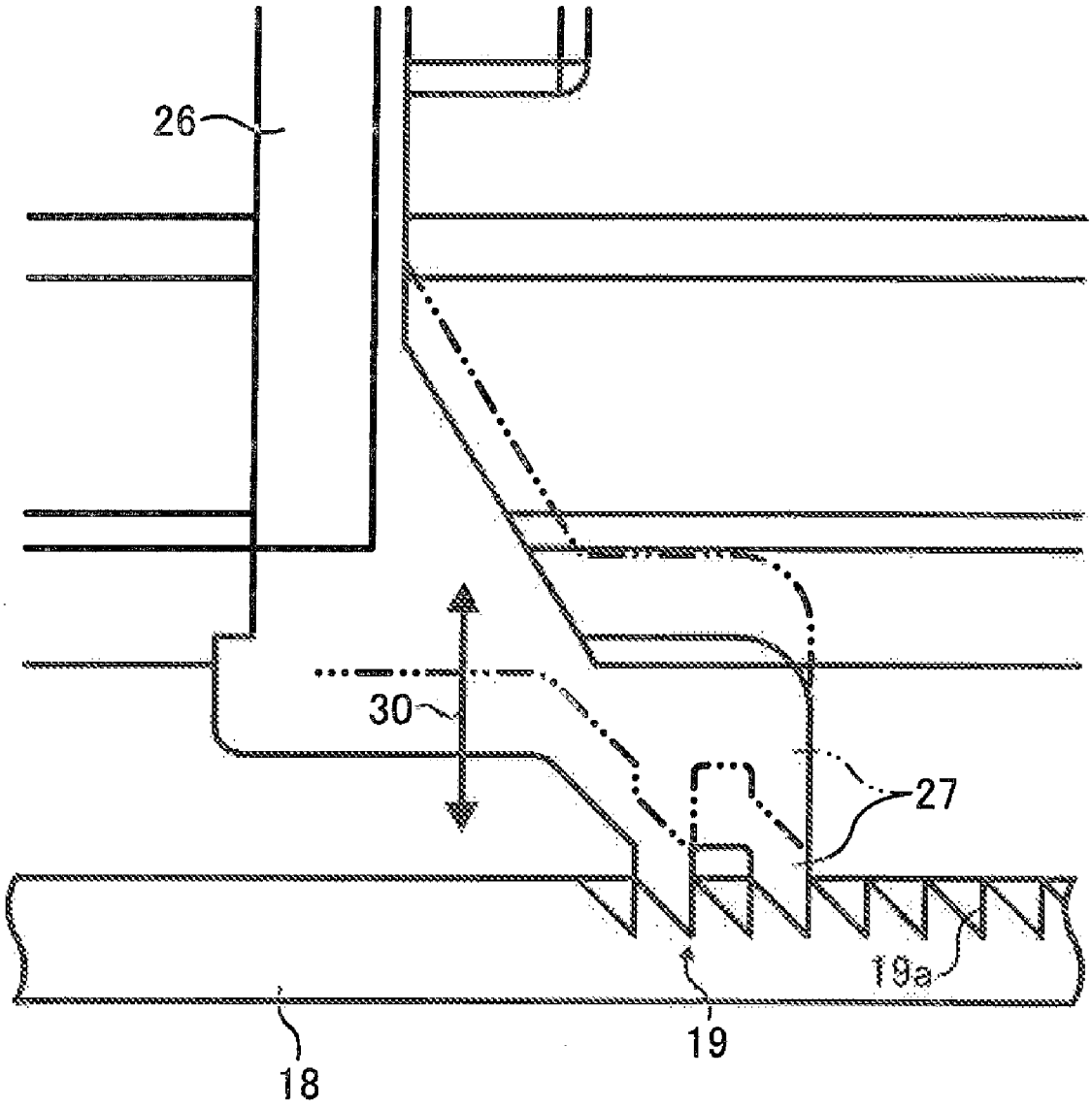
FIG. 9 is a cross-section view showing the tooth and the trench according to an embodiment of the present invention.

As illustrated in FIG. 9, the direction of movement of the tooth portion 27 is parallel with the surface of a vertical wall 19*a* of the trench 19. Consequently, the tooth portion 27 can smoothly release engagement from the surface of a vertical wall 19*a*.

In this embodiment of the invention, there are two teeth portions 27 aligned to the moving direction of the side fence 9*a*. The two teeth portions 27 engage the two walls 19*a* of the trench 19 simultaneously. Even if the portions 27 engage the walls 19*a* of the trench 19, the teeth portions 27 can release engagement from the vertical walls 19*a* smoothly. Further, if the length of one tooth portion varies from the length of a second tooth position, variations of fixing force between the fixing portion 21 and the trench is small because the tooth portions 27 engage the walls 19*a* of the trench 19. In this embodiment, the lever 20 forms part of the side fence 9*a*; however, the lever may be molded integrally with the side fence 9*a*. Further, the leaf spring 29 exerts a force on the fixing portion 21.

Figure 10:
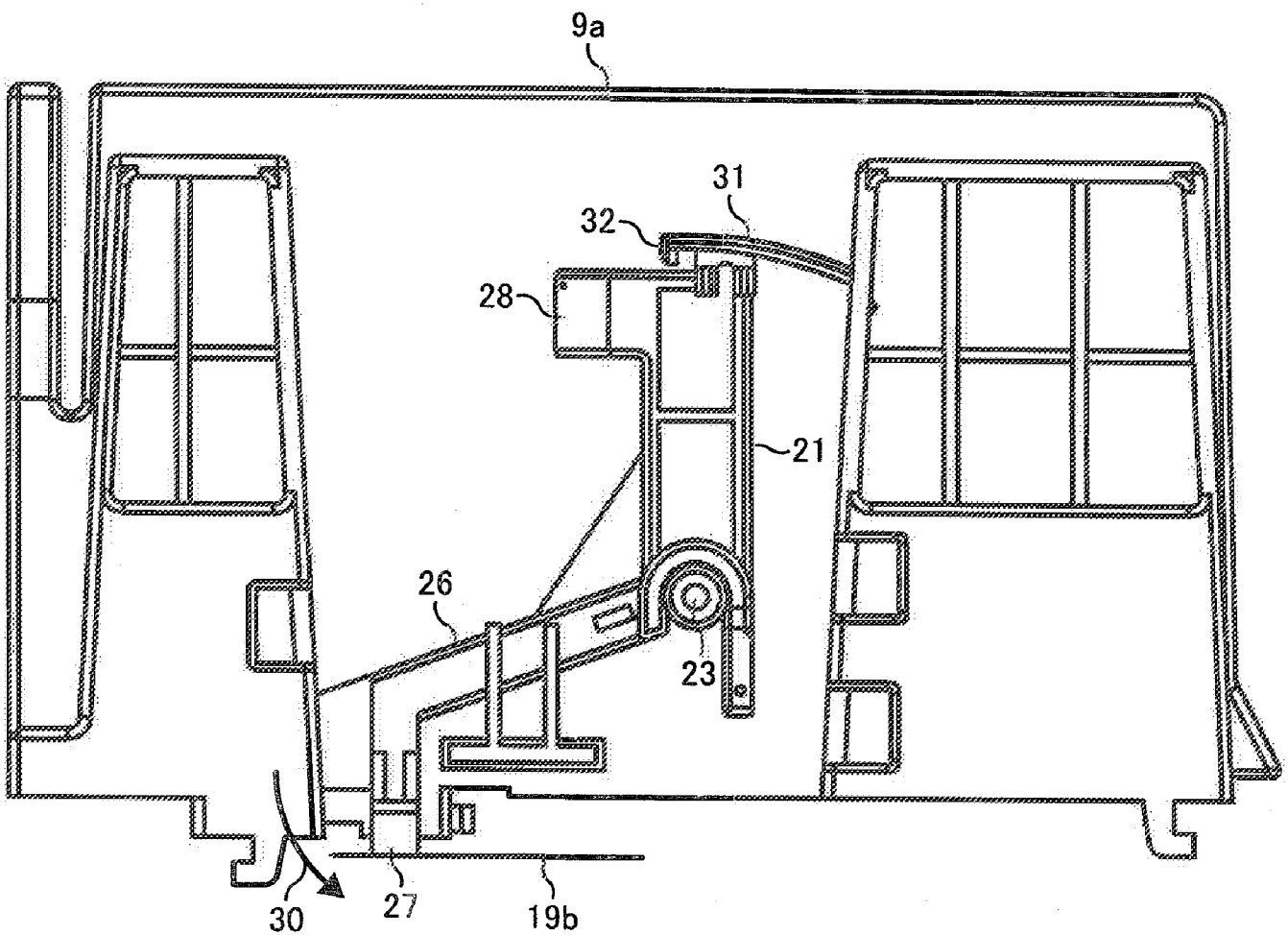
FIG. 10 is a side view of a fixing structure of a fence according to an embodiment of the present invention that does not have a bias element for a fixing portion.

However, as illustrated in FIG. 10, the fixing portion 21 can rotate due to its own weight. In FIG. 10, element 19*b* reflects a bottom of the trench 19. In this embodiment, the leaf spring 29 (See FIG. 11) exerts a force on the box portion 50. However, as illustrated in FIG. 10, the fixing portion 21 can rotate due to its own weight. In FIG. 10, a numeral 19*b* means a bottom of the trench 19.

When using the weight of the fixing portion to rotate the fixing portion 21, the user can fix the side fences 9*a*, 9*b* using the weight of the fixing portion 21 if the user releases the lever 20. Specifically, the fixing main body 25 and the tooth portion 27 rotate due to their own weight, and the engagement is completed by the contact of the bottom of the tooth portion 27 and the bottom 19*b* of the trench 19.

However, the fixing main body 25 and the tooth portion 27 cannot rotate if the friction between the tooth portion 27 and the wall 19*a* is excessive and the weight of the fixing portion 21 is low because the fixing portion 21 is a molded synthetic resin.

In this case, the side fences 9*a*, 9*b* are not fixed and the sheet may skew. Consequently, exerting a force to the fixing portion 21 is preferable.

Figure 11:
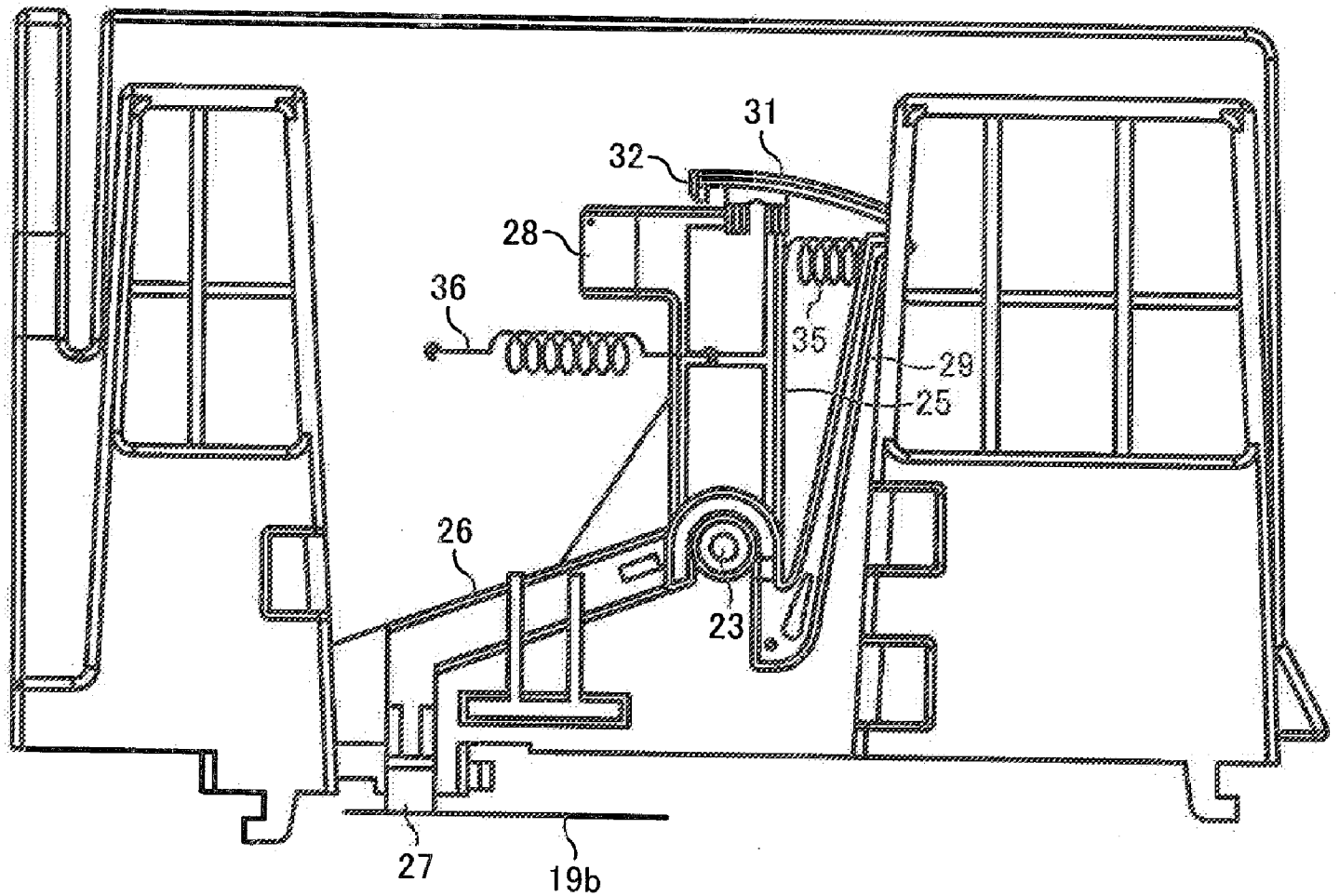
FIG. 11 is a side view of a fixing structure of a fence according to an embodiment of the present invention that has a spring as a bias element of a fixing portion.

As a preferable means to exert a force to the fixing portion 21 (except for using leaf spring 29), as illustrated in FIG. 11, a compression spring 35 can be provided on the opposite side of the fixing main body 25 to the tooth portion 27. A tension spring 36 can be provided on the same side of the fixing main body 25 to the tooth portion 27.

Figure 12:
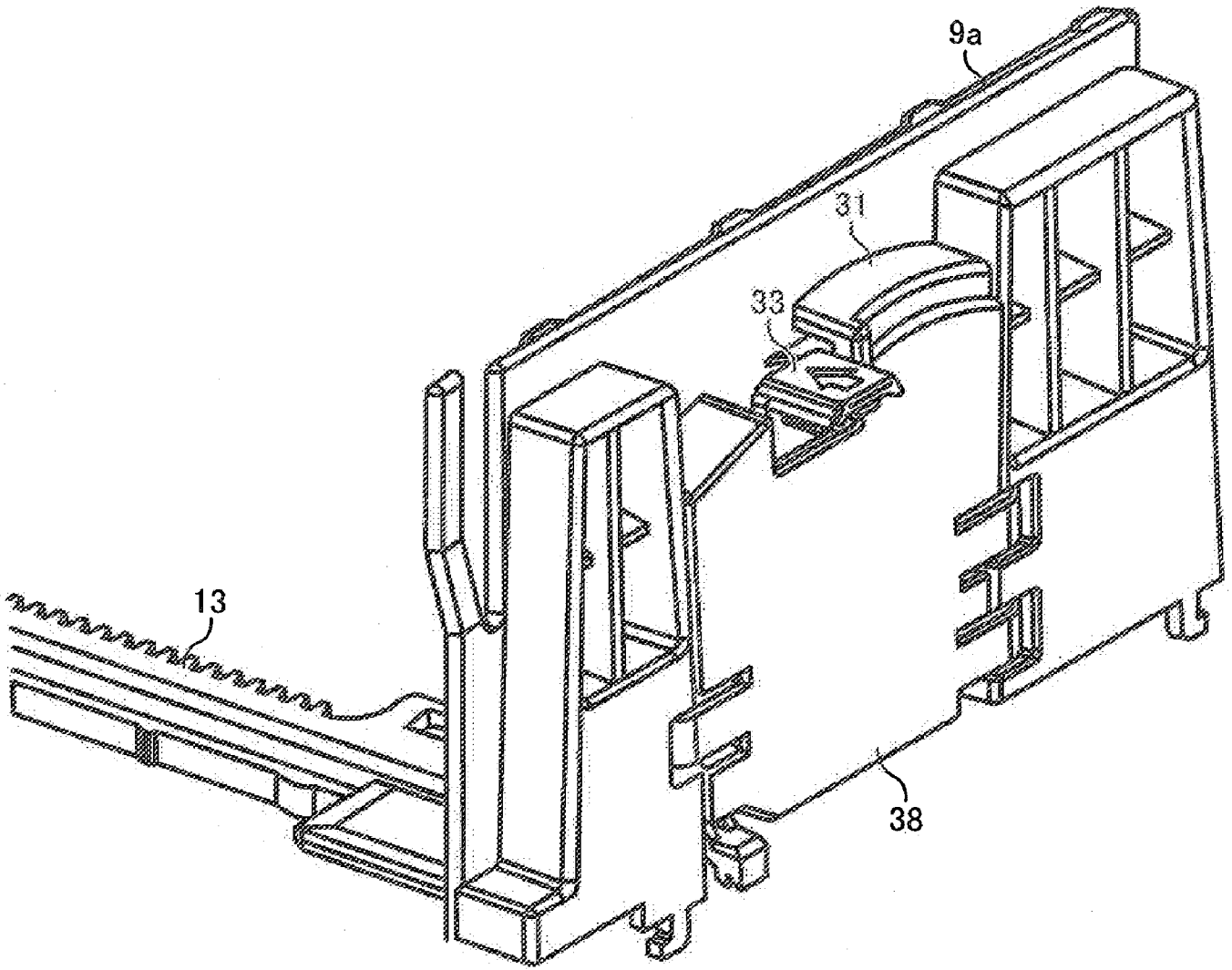
FIG. 12 is a side view of a fixing structure of a fence according to a second embodiment of the present invention.
Figure 13:
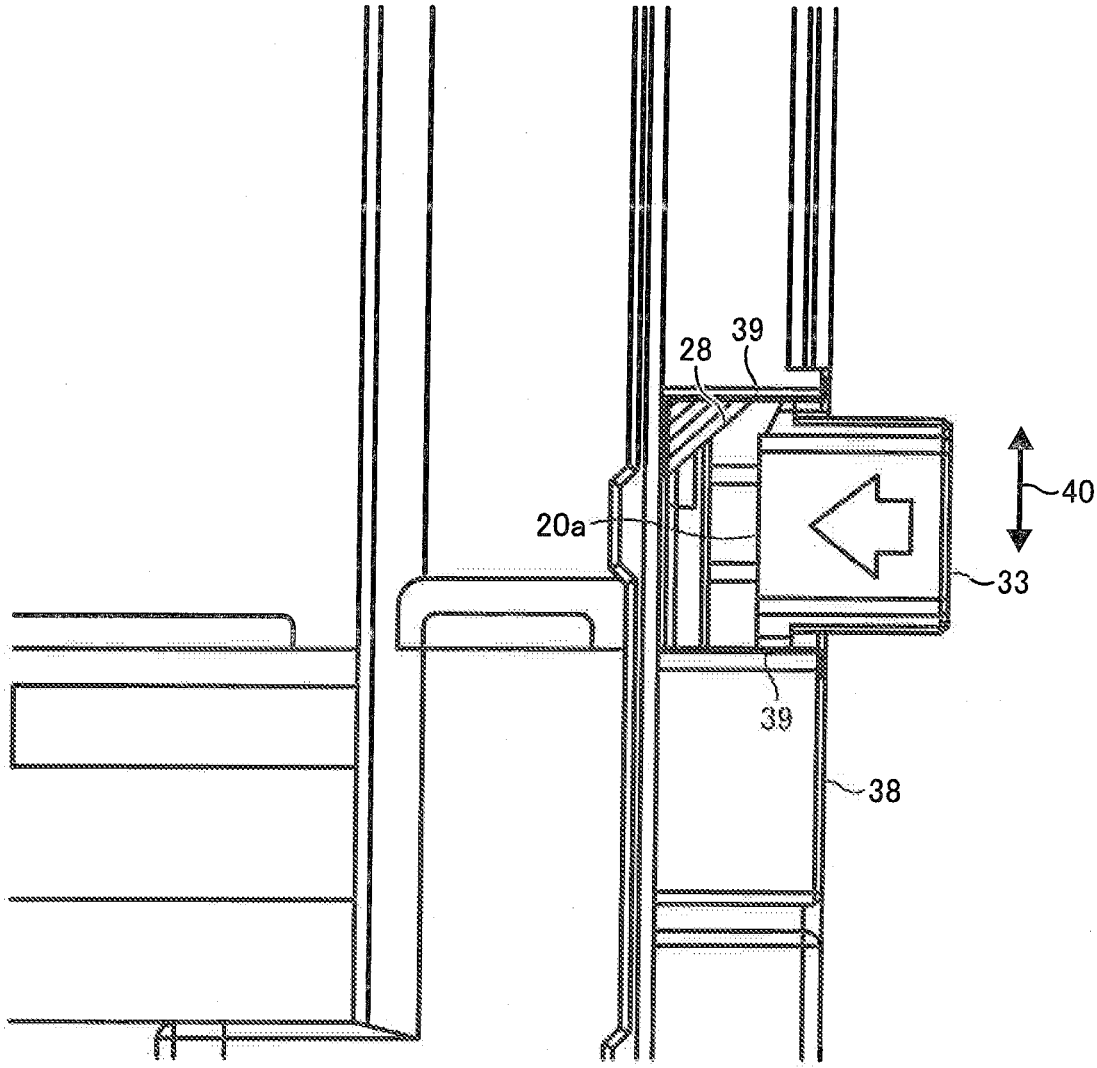
FIG. 13 is a plane view of a fixing structure of a fence according to a second embodiment of the present invention.

FIG. 12 and FIG. 13 show the second embodiment of the present invention. The same reference numbers are used to identify like parts used by the first embodiment.

Figure 15:
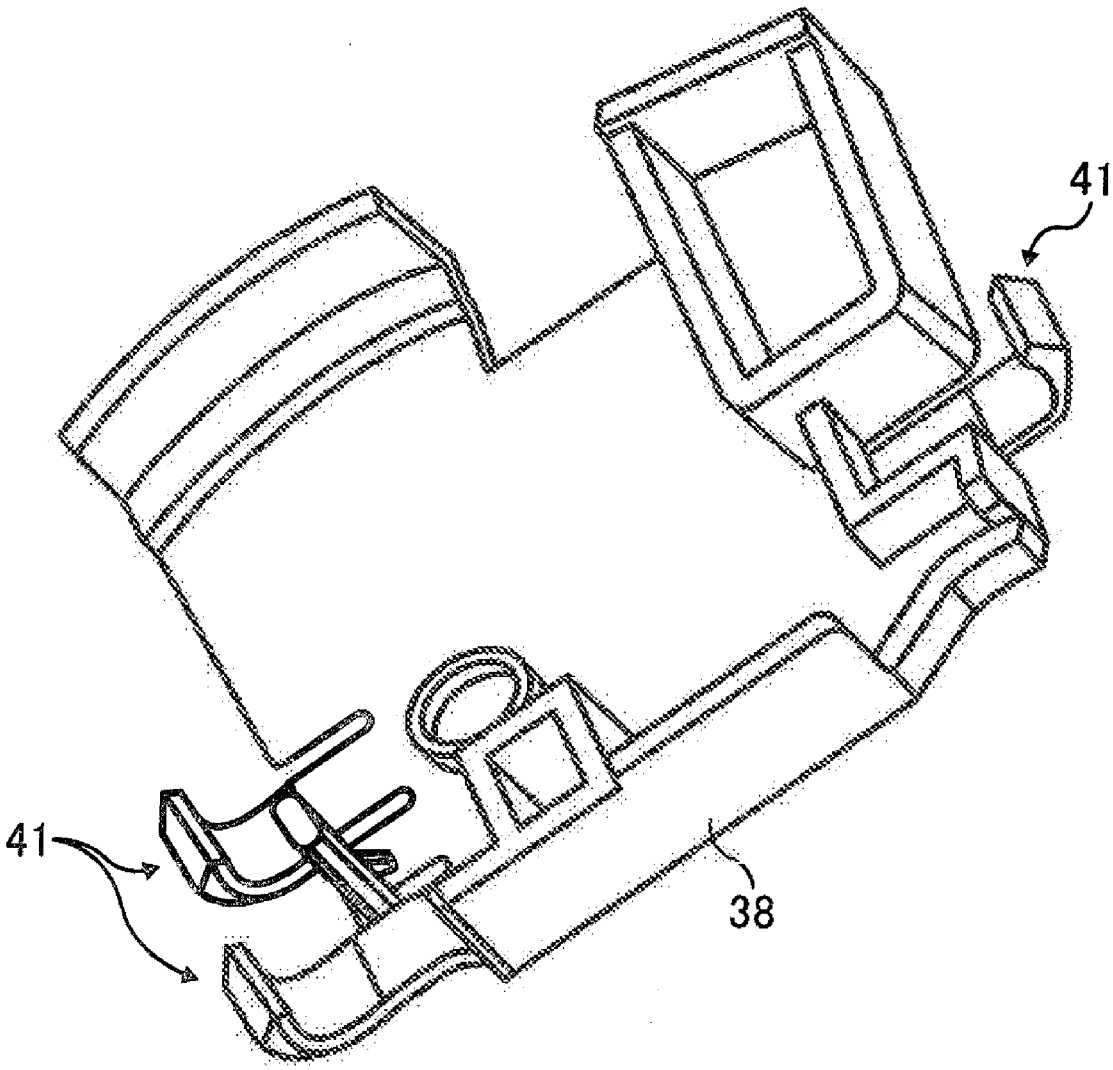
FIG. 15 is a perspective view of a cover according to a second embodiment of the present invention.

As illustrated in FIG. 12, the feature of the second embodiment is a cover 38 that covers entirely the fixing portion 21 to improve aspects of the fence 9*a*, 9*b*. The cover 38 is large enough to cover the fixing portion and the lever entirely except for the knob 33. The cover 38 improves aspects of the sheet feeding cassette 1 because the cover 38 covers a rotating structure of the fixing portion 21. The cover 38 is attached to the side fence 9*a* to prevent hooks 41 (illustrated in FIG. 15) from falling that are formed integrally to the cover 38.

As illustrated in FIG. 13, a guide member 39 is provided on the top of the cover 38 to regulate the movement perpendicular to the direction of the movement of the lever 20 (the direction of the movement of the lever 20 is show as an arrow 40).

A guide member 39 regulates a meandering motion of the lever 20 toward the arrow 40. The slope portion 28 contacts the same position of the inner portion 20*a* of the lever. Consequently, the operation of fixing and releasing the fence is stable.

Figure 14:
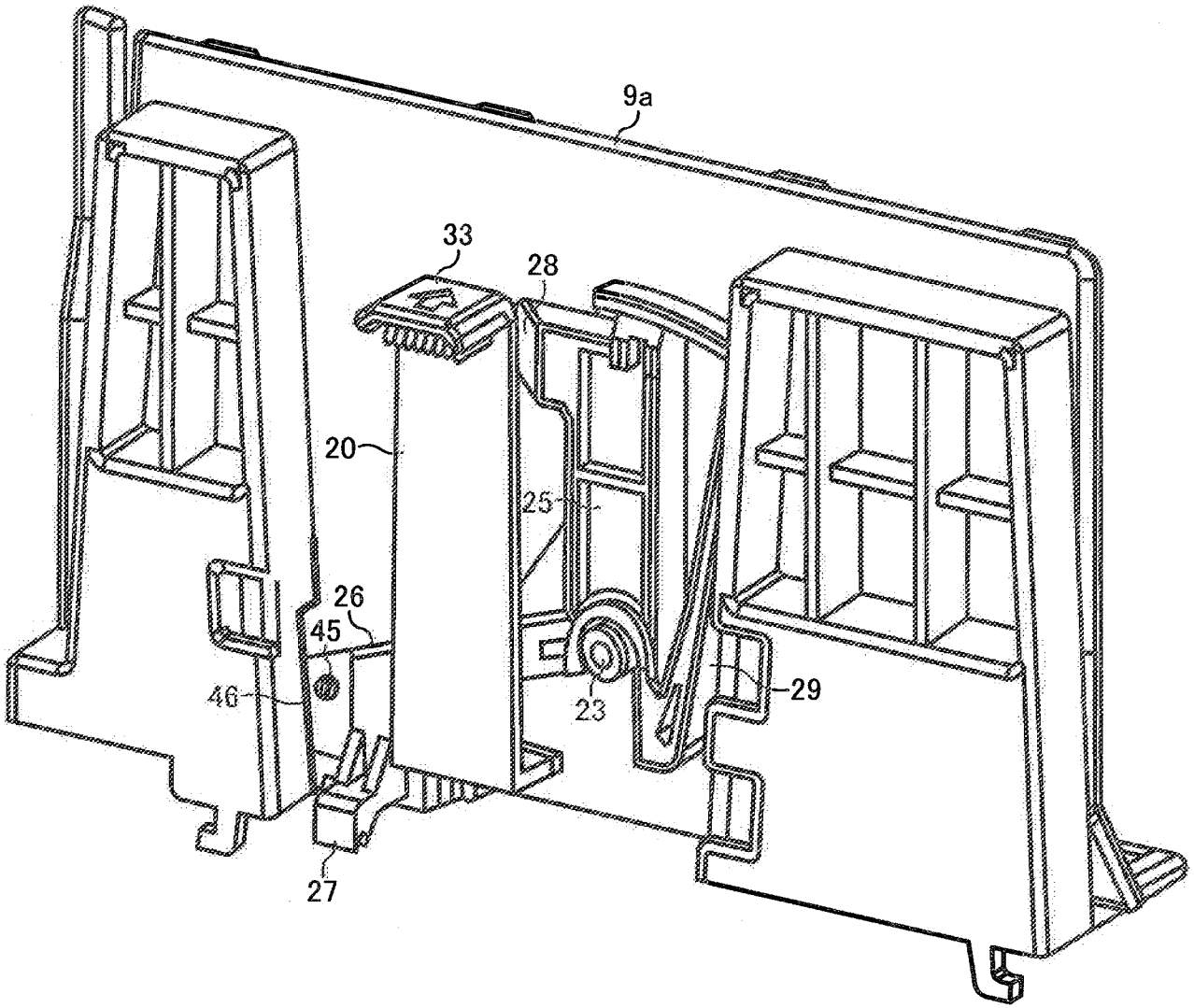
FIG. 14 is a perspective view of a fixing structure of a fence according to a third embodiment of the present invention.

FIG. 14 shows a third embodiment of the invention. The same reference numbers are used to identify like parts used by the first embodiment.

As illustrated in FIG. 14, the feature of the third embodiment is a convex portion 45 which forms part of the arm 26 of the fixing portion 21 via the tooth portion 27. A concave portion 46 is provided on the side fence 9*a* to engage the convex portion 45. Specifically, the position of the convex portion 45 correlates to the position of the concave portion 46. The convex portion 45 engages the concave portion 46 to engage the tooth portion 27 with the trench 19, which has an interspace between the bottom of the tooth portion 27 and the bottom 19*b*.

In FIG. 14, the convex portion 45 and the concave portion 46 are shown separately for easy comprehension.

In case the user accidentally closes the fences 9*a*, 9*b* without releasing the fixing portion 21, the engagement between the convex portion 45 and the concave portion 46 can withstand the closing force of the side fences 9*a*, 9*b*. Specifically, the force of closing the side fence 9*a*, 9*b* is minimally exerted on the tooth portion 27 and damage to the tooth portion 27 of the fixing portion 21 can be prevented.

Numerous additional modifications and variations of the present invention are possible in light of the above teachings. It is therefore understood that within the scope of the appended claims, the present invention may be practiced other than as specifically described.

What is claimed is:

1. A sheet feeding cassette, comprising:

a main body configured to accommodate at least one sheet, and including a trench;

a fence attached to the main body and configured to move bi-directionally to define a setting position for the at least one sheet;

a fixing portion including a tooth portion configured to engage with the trench to fix a position of the fence, the fixing portion is configured to rotate in a direction substantially perpendicular to the moving direction of the fence; and a lever portion configured to contact the fixing portion when moved in a direction parallel to the moving direction of the fence resulting in a rotation of the fixing portion, wherein the lever portion or the fixing portion includes a slope portion, the lever portion pushes the fixing portion via contact with the slope portion, and the fixing portion is moved by component force generated on the slope portion.

2. The sheet feeding cassette according to claim 1, wherein the lever portion and the fence are integrally formed.

3. The sheet feeding cassette according to claim 1, further comprising:

a biasing device configured to bias the fixing portion.

4. The sheet feeding cassette according to claim 3, wherein:

the biasing device includes a compression spring.

5. The sheet feeding cassette according to claim 3, wherein:

the biasing device includes a tension spring.

6. The sheet feeding cassette according to claim 1, further comprising:

a cover configured to cover substantially all of the fixing portion.

7. The sheet feeding cassette according to claim 6, wherein the cover includes a guide portion configured to regulate a deflection in a direction perpendicular to the direction of movement of the lever portion.

8. The sheet feeding cassette according to claim 1, wherein the fixing portion includes a protruding portion and the fence includes a catching portion configured to catch the protruding portion.

9. The sheet feeding cassette according to claim 1, wherein the fixing portion includes a plurality of teeth formed in the moving direction of the fence.

10. An image forming apparatus including a sheet feeding cassette, comprising:

a main body configured to accommodate at least one sheet, and including a trench;

a fence attached to the main body and configured to move bi-directionally to define a setting position for the at least one sheet;

a fixing portion including a tooth portion configured to engage with the trench to fix a position of the fence, the fixing portion is configured to rotate in a direction substantially perpendicular to the moving direction of the fence; and a lever portion configured to contact the fixing portion when moved in a direction parallel to the moving direction of the fence resulting in a rotation of the fixing portion, wherein the lever portion or the fixing portion includes a slope portion, the lever portion pushes the fixing portion via contact with the slope portion, and the fixing portion is moved by component force generated on the slope portion.

11. A sheet feeding cassette, comprising:

means for accommodating at least one sheet;

setting means, attached to the means for accommodating, for defining a setting position for the at least one sheet by moving bi-directionally;

fixing means for fixing a position of the setting means, the fixing means rotatable in a direction substantially perpendicular to the moving direction of the setting means; and engagement means in contact with the fixing means when moved in a direction parallel to the moving direction of the fixing means for causing a rotation of the fixing means, wherein the engagement means or fixing means includes a slope portion, the engagement means pushes the fixing means via contact with the slope portion, and the fixing means is moved by component force generated on the slope portion.

12. The sheet feeding cassette according to claim 11, further comprising:

means for biasing the fixing portion.

13. The sheet feeding cassette according to claim 11, further comprising:

means for covering substantially all of the fixing portion.

14. The sheet feeding cassette according to claim 13, wherein the means for covering includes means for regulating a deflection in a direction perpendicular to the direction of movement of the means for setting.

15. A sheet feeding cassette, comprising:

a main body configured to accommodate at least one sheet, and including a trench;

a fence attached to the main body and configured to move bi-directionally to define a setting position for the at least one sheet;

a fixing portion including a tooth portion configured to engage with the trench to fix a position of the fence, the fixing portion is configured to rotate in a direction substantially perpendicular to the moving direction of the fence;

a lever portion configured to contact the fixing portion when moved in a direction parallel to the moving direction of the fence resulting in a rotation of the fixing portion; and a cover configured to cover substantially all of the fixing portion, wherein the cover includes a guide portion configured to regulate a deflection in a direction perpendicular to the direction of movement of the lever portion.

* * * * *